US010427860B2

(12) United States Patent
Regnier

(10) Patent No.: US 10,427,860 B2
(45) Date of Patent: Oct. 1, 2019

(54) PACKAGING

(71) Applicant: SOCIETE D'EMBALLAGE ET DE CONDITIONNEMENT S.E.M.C.O., Le Thales 9eme etage (MC)

(72) Inventor: Wenael Regnier, Nice (FR)

(73) Assignee: SOCIETE D'EMBALLAGE ET DE CONDITIONNEMENT S.E.M.C.O., Le Thales 9eme Etage (MC)

( * ) Notice: Subject to any disclaimer, the term of this patent is extended or adjusted under 35 U.S.C. 154(b) by 4 days.

(21) Appl. No.: 15/126,818

(22) PCT Filed: Mar. 17, 2015

(86) PCT No.: PCT/EP2015/055586
§ 371 (c)(1),
(2) Date: Sep. 16, 2016

(87) PCT Pub. No.: WO2015/140185
PCT Pub. Date: Sep. 24, 2015

(65) Prior Publication Data

US 2017/0088338 A1 Mar. 30, 2017

(30) Foreign Application Priority Data

Mar. 18, 2014 (FR) ..... 14 52203

(51) Int. Cl.
*B65D 83/00* (2006.01)
*B65D 75/00* (2006.01)
(Continued)

(52) U.S. Cl.
CPC ..... *B65D 83/0055* (2013.01); *B31B 50/16* (2017.08); *B31B 50/64* (2017.08);
(Continued)

(58) Field of Classification Search
CPC ..... B65D 83/0055; B65D 47/2031; B65D 35/10; B65D 35/44; B65D 75/008;
(Continued)

(56) References Cited

U.S. PATENT DOCUMENTS 560,984 A * 5/1896 Funk ..... B65D 1/32 222/215
D27,261 S * 6/1897 Beach ..... D9/544
(Continued)

FOREIGN PATENT DOCUMENTS

DE 14 86 604 1/1970
EP 1 426 301 6/2004
(Continued)

OTHER PUBLICATIONS

International Search Report for corresponding International PCT application No. PCT/EP2015/055586.
(Continued)

*Primary Examiner* — Paul R Durand
*Assistant Examiner* — Randall A Gruby
(74) *Attorney, Agent, or Firm* — Hauptman Ham, LLP

(57) ABSTRACT

Packaging comprising a pouch for containing a product and allowing the release thereof, comprising a manually deformable jacket comprising a first flexible film. The first film being closed on itself so as to form a frustum having a first end and a second end, the cross section of the frustum narrowing toward the first end. The packaging also comprising a base formed by a second flexible film and sealed at the second end of the frustum so as to close the second end, the base and the jacket being sealed "wrong-side to wrong-side" so as to form together a manually deformable pouch. The packaging also comprising a closure device through which the product is intended to flow during release and comprising a sleeve sealed at the first end of the frustum.

20 Claims, 9 Drawing Sheets

(51) Int. Cl.

| | |
|---|---|
| ***B65D 75/58*** | (2006.01) |
| ***B65D 47/20*** | (2006.01) |
| ***B65D 35/10*** | (2006.01) |
| ***B65D 35/44*** | (2006.01) |
| ***B31B 50/16*** | (2017.01) |
| ***B31B 50/64*** | (2017.01) |

(52) U.S. Cl.
CPC ..... *B65D 35/10* (2013.01); *B65D 35/44* (2013.01); *B65D 47/2031* (2013.01); *B65D 75/008* (2013.01); *B65D 75/5883* (2013.01)

(58) Field of Classification Search
CPC ..... B65D 75/5883; B26C 66/4322; B29L 2023/20; B29D 23/20; B31B 1/16; B31B 1/64
See application file for complete search history.

(56) References Cited

U.S. PATENT DOCUMENTS 666,443 A * 1/1901 Smith ..... B65D 35/12 220/621
1,100,448 A * 6/1914 Selz ..... 229/113
1,293,860 A * 2/1919 Mock ..... B65D 35/12 222/92
D57,312 S * 3/1921 Connor ..... D9/783
D60,286 S * 1/1922 Eberhart ..... D9/783
D60,288 S * 1/1922 Eberhart ..... D9/783
1,481,339 A * 1/1924 Frank ..... B65D 35/14 222/107
1,536,443 A * 5/1925 Lermer ..... B65D 35/10 222/107
1,658,233 A * 2/1928 Falk ..... B65D 47/2031 222/490
1,720,497 A * 7/1929 Vierengel ..... B65D 3/06 229/400
1,817,732 A * 8/1931 Boruss ..... B65D 35/02 206/1.7
1,853,028 A * 4/1932 Aronson ..... B65D 35/38 141/383
D92,148 S * 5/1934 McGiveran ..... D9/573
1,967,931 A * 7/1934 Fox ..... B65D 3/06 229/198.2
2,110,928 A * 3/1938 De Buys ..... A61J 9/001 215/11.3
2,129,839 A * 9/1938 Henderson ..... B65D 35/12 222/107
2,268,993 A * 1/1942 Sanders ..... B65D 35/02 215/382
2,274,173 A * 2/1942 Temple ..... B65D 35/12 220/600
2,274,258 A * 2/1942 Roselle ..... B65D 35/12 220/617
D136,477 S * 10/1943 Roselle ..... D9/697
2,383,230 A * 8/1945 Voke ..... B65D 35/12 156/218
2,430,046 A * 11/1947 Dreyfus ..... B65D 35/18 138/128
2,441,649 A * 5/1948 Sprague ..... B65D 35/38 222/544
2,524,021 A * 9/1950 Rigby ..... A61J 9/005 215/11.3
2,584,095 A * 1/1952 Slaughter ..... B65D 35/10 156/305
2,626,647 A * 1/1953 Barton ..... B29C 66/137 220/612
2,671,579 A * 3/1954 Knoblock ..... B65D 35/10 222/105
2,682,974 A * 7/1954 Smith ..... B65D 35/10 156/190
2,686,616 A * 8/1954 Barlow ..... B65D 35/14 222/107
2,718,983 A * 9/1955 Deskey ..... B65D 35/02 222/92
2,723,779 A * 11/1955 Parker ..... B65D 35/10 215/2
2,741,402 A * 4/1956 Sayre ..... B29C 65/362 220/612
2,792,149 A * 5/1957 Lutz ..... B65D 47/2031 222/107
3,144,964 A * 8/1964 Goff ..... B65D 35/12 222/106
3,211,342 A * 10/1965 De Wayne Miles ... B65D 35/18 222/107
3,288,334 A * 11/1966 Corsette ..... B05B 11/0043 222/107
3,290,422 A * 12/1966 Michel ..... B29C 45/14598 264/259
3,307,738 A * 3/1967 Scheindel ..... B29C 53/36 220/678
3,317,110 A * 5/1967 Palmer ..... B29C 53/285 220/671
3,353,714 A * 11/1967 Trecek ..... B29C 53/06 222/107
3,431,829 A * 3/1969 Goodwin ..... B65D 31/14 493/199
3,434,644 A * 3/1969 Collie ..... B65D 11/10 215/379
3,434,906 A * 3/1969 De Greeve ..... B29C 53/30 156/466
3,604,491 A * 9/1971 Spiess ..... B65D 75/008 383/104
3,648,895 A * 3/1972 Strazdins ..... B65D 35/04 138/119
3,817,427 A * 6/1974 Neff ..... B65D 35/12 220/617
3,832,964 A * 9/1974 Rockefeller ..... B21D 51/36 29/525
D234,077 S * 1/1975 Peterson ..... D9/544
3,874,558 A * 4/1975 Rockefeller ..... B29C 53/42 220/613
3,976,224 A * 8/1976 Ericson ..... B65D 35/02 222/107
4,060,179 A * 11/1977 McGhie ..... B65D 35/12 220/613
4,126,249 A * 11/1978 Wood ..... B65D 35/08 222/92
4,265,948 A * 5/1981 Hayes ..... B32B 15/08 222/92
4,295,582 A * 10/1981 Acres ..... B65D 83/0055 141/27
4,301,939 A * 11/1981 Pupp ..... B65D 43/021 220/267
4,337,104 A * 6/1982 Lynn ..... C12M 23/28 156/244.13
4,355,756 A * 10/1982 Furuya ..... B65D 3/22 229/4.5
4,406,607 A * 9/1983 Wildmoser ..... B29C 53/20 264/296
4,471,882 A * 9/1984 Joo ..... B65D 11/04 220/62.22
4,527,699 A * 7/1985 Namba ..... B65D 15/22 215/12.2
4,678,092 A 7/1987 Rane
5,105,985 A * 4/1992 Kroeber ..... B65D 47/2031 222/107
5,263,606 A * 11/1993 Dutt ..... B29C 65/08 156/272.2
5,484,083 A * 1/1996 Joulia ..... B05B 11/0024 222/107
5,730,694 A * 3/1998 Hagleitner ..... B65D 11/04 220/613
5,860,565 A * 1/1999 Winston ..... B65D 35/22 222/1
5,871,119 A 2/1999 Blackinton
D585,763 S * 2/2009 Friebe ..... D9/708
D599,676 S * 9/2009 Friebe ..... D9/708
D607,744 S * 1/2010 Laird ..... D9/454

(56) References Cited

U.S. PATENT DOCUMENTS

| | | | | |
|---|---|---|---|---|
| D609,112 | S * | 2/2010 | Koyanagi | D9/708 |
| 8,083,092 | B2 * | 12/2011 | Hartstock | A45D 40/00 206/459.5 |
| 8,096,448 | B2 * | 1/2012 | Keller | B29C 31/002 206/277 |
| 8,468,782 | B2 * | 6/2013 | Michalsky | B65D 75/008 156/229 |
| 8,783,515 | B2 * | 7/2014 | Branyon | B31C 1/04 215/44 |
| D769,130 | S * | 10/2016 | Lederer | D9/708 |
| 2003/0053723 | A1 | 3/2003 | Lanham et al. | |
| 2004/0026432 | A1 | 2/2004 | Matsumura et al. | |
| 2004/0052987 | A1 * | 3/2004 | Shetty | B31C 3/04 428/34.2 |
| 2004/0124210 | A1 | 7/2004 | Bartlein | |
| 2005/0265636 | A1 | 12/2005 | Michalsky | |
| 2007/0000943 | A1 | 1/2007 | Morgan | |
| 2007/0278116 | A1 | 12/2007 | Michalsky | |
| 2008/0184548 | A1 | 8/2008 | Michalsky | |
| 2009/0041394 | A1 | 2/2009 | Michalsky | |
| 2009/0061037 | A1 | 3/2009 | Sander | |
| 2009/0120931 | A1 * | 5/2009 | Murray | B65B 3/027 220/200 |
| 2011/0068119 | A1 | 3/2011 | Wurster | |
| 2013/0075393 | A1 * | 3/2013 | Haynie | B65D 37/00 220/6 |
| 2014/0174035 | A1 * | 6/2014 | Murray | B65D 75/5883 53/452 |
| 2014/0366490 | A1 * | 12/2014 | Saito | B31F 1/0093 53/452 |
| 2015/0203256 | A1 * | 7/2015 | Solle | B65D 47/12 222/107 |

FOREIGN PATENT DOCUMENTS

| | | |
|---|---|---|
| EP | 1 274 629 | 2/2007 |
| EP | 1 732 824 | 12/2008 |
| GB | 1 251 668 | 10/1971 |
| JP | S47-021196 | 7/1972 |
| JP | S61-127461 | 6/1986 |
| JP | S63-022341 | 1/1988 |
| JP | H07-004374 | 1/1995 |
| JP | 2005-119665 | 5/2005 |
| JP | 2007-269398 | 10/2007 |
| JP | 2013-158924 | 8/2013 |
| JP | 2013-193740 | 9/2013 |
| WO | 01/51359 | 7/2001 |
| WO | 01/94219 | 12/2001 |
| WO | 2012/017938 | 2/2012 |
| WO | 2012017938 | 10/2013 |

OTHER PUBLICATIONS

Notice of Reasons for Rejection from corresponding Japanese Application No. 2017-500413, dated Dec. 17, 2018, pp. 1-4, Japan Patent Office, Tokyo, Japan.

* cited by examiner

PACKAGING

TECHNICAL FIELD OF THE INVENTION

The present invention relates to the field of packaging and more particularly the field of packaging intended to contain a substance, the release of which is obtained by pressure exerted manually on the packaging and/or by gravity. It finds particularly advantageous applications in the food, industrial, cosmetic, domestic and pharmacological sectors and health in general.

PRIOR ART

In the patisserie field, for example, in order to deposit or pour patisserie cream, the use of a sleeve pouch is usual. A sleeve pouch consists of a conical pouch having two ends with different cross sections. The larger end is not closed but open. The devices of this type have drawbacks related to their poor release, to the absence of a stopper and therefore the need to use the content entirely at the risk of significant waste. Furthermore, once opened, sleeve pouches do not keep their shape by themselves and cannot therefore be rested on a work surface without their content pouring out. However, the use of a sleeve pouch affords very good handleability, a precise feel and therefore a significant "product" sensation, very good control of the doses delivered and very good release of the product.

Release means the ratio between the quantity of product initially contained in the sleeve pouch and the content inevitably remaining at the end of use. Good release implies great ability to extract the entire content of the container.

In order to solve the drawbacks mentioned above, the packaging field also uses flasks or bottles formed by a continuous external enclosure made from a material of the plastic type but also tubes. These packages have better vertical holding than a sleeve pouch. They normally have a stopper making it possible to close the package. Finally, they allow easy deposition of the content. However, this type of packaging has very low release of the product. This is because, at the end of use, there remains a not insignificant quantity of product that it is impossible to extract. Moreover, they are not pleasant to the touch.

One object of the present invention is therefore to propose a device solving at least some of the aforementioned drawbacks.

SUMMARY OF THE INVENTION

According to one embodiment, the present invention relates to packaging comprising a pouch intended to contain a product and to allow release thereof, characterised in that it comprises:

- a manually deformable jacket, comprising a first film, for example and preferably multilayer, sufficiently flexible to deform under the action of its weight, the film being closed on itself so as to form a frustum having a first and second end, the cross section of the frustum narrowing as the first end is approached;
- a base formed by a second film, for example and preferably multilayer, sufficiently flexible to deform under the action of its weight. The base is sealed at the second end of the frustum so as to close off the second end. According an optional but particularly advantageous embodiment, the base and the jacket are sealed "wrong-side to wrong-side" in order to form together a manually deformable pouch.

- a closure device through which the product is intended to flow during release and comprising a sleeve sealed to the first end of the frustum.

This device affords very good handleability and very significant "product" feel and sensation. This is because it has the advantage of the sleeve pouch, namely a flexible body, deformable by simple pressure exerted manually by the user with one or two hands. The flexibility of the pouch affords very good release of the product and improves control of the pressure exerted. This level of control affords very precise distribution of the doses. Finally, this pouch has improved vertical holding, with the sleeve upwards, through the cooperation of the flexible jacket with the flexible base. This is because the jacket-base sealing confers mechanical reinforcement on the pouch. This sealing has a thickness that is the sum of the thicknesses of the jacket and base. In addition, according to the type of accessory used at the sleeve, the device can be held vertical, sleeve upwards. This advantageous position facilitates the flow of the product inside the flexible pouch.

According to another aspect, the present invention relates to a method for manufacturing the device of the invention, comprising the following series of steps:

- cutting a pattern of the jacket from a film;
- manipulation of the pattern of the jacket in order to form a frustum;
- sealing "skin against wrong-side" of the jacket by a heating device able to come into contact with the internal face and the external face of the jacket forming a frustum.

Various options that the manufacturing method according to the invention may preferentially but not limitatively have are stated below, these options being able to be implemented either alone or in any combination with each other:

- after the sealing of the jacket to form a frustum, a step of sealing the jacket with either the sleeve or the base;
- according to one embodiment, after the step of sealing the jacket with one from either the sleeve or the base, a step of filling the device with a product through one end of the frustum that has remained open is performed, in which, after the filling step, a step of sealing the jacket with the other one from the sleeve and base is performed. Alternatively, after the step of sealing the jacket with one from either the sleeve or the base, a step of sealing the jacket with the other one from the sleeve and the base is performed, and then a step of filling the device with a product through a sleeve is performed.

BRIEF DESCRIPTION OF THE FIGURES

The aims, objects, features and advantages of the invention will emerge more clearly from the detailed description of an embodiment thereof that is illustrated by the following accompanying drawings, in which.

Figure 1A:
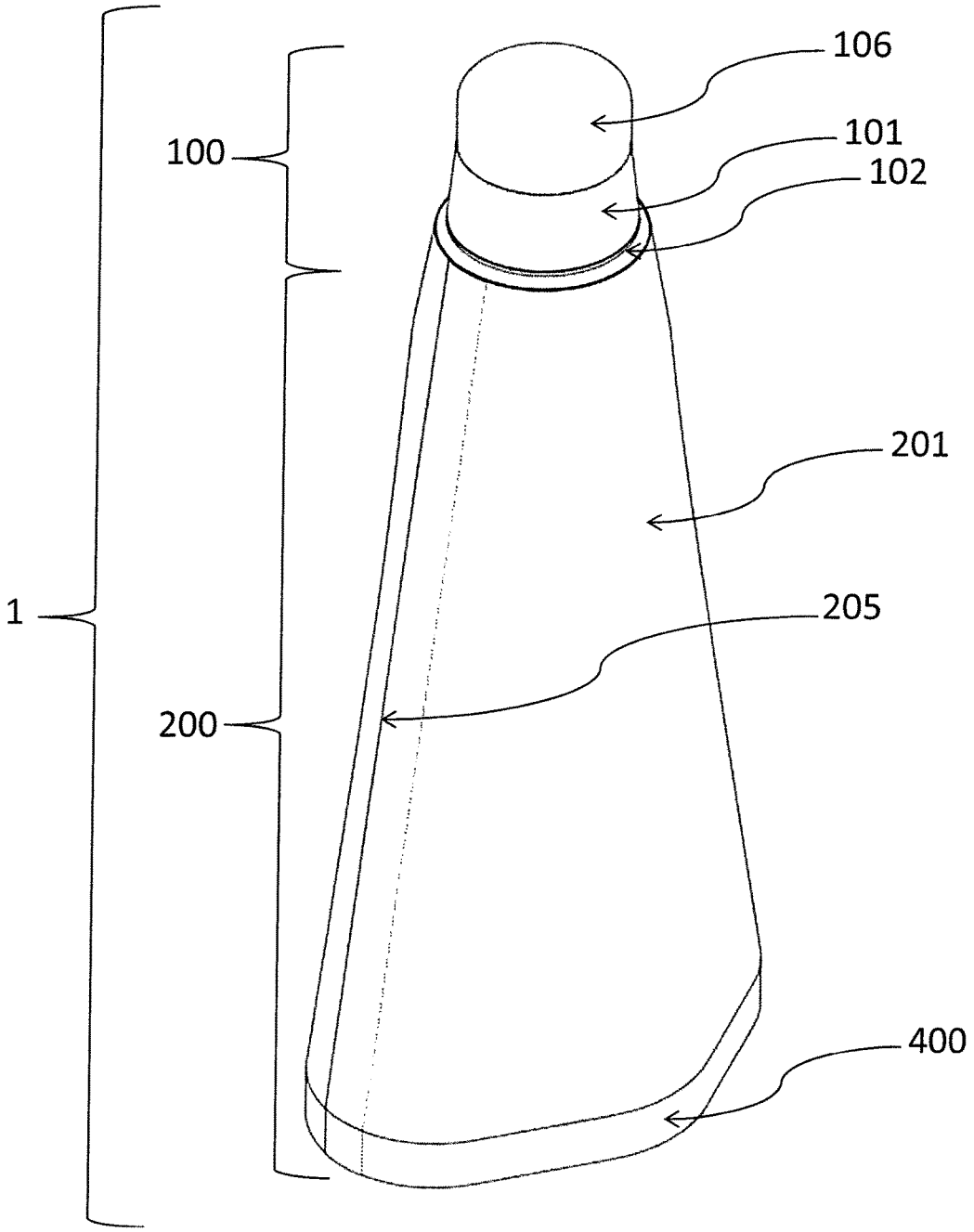
FIG. 1*a* depicts a perspective view of an example of a device according to one embodiment of the present invention with a lid and an accessory.

The drawings are given by way of examples and are not limitative of the invention. They constitute outline schematic representations intended to facilitate understanding of the invention and are not necessarily to the scale of practical applications.

DETAILED DESCRIPTION OF THE INVENTION

In the context of the present invention, a jacket is said to be "supple" or "flexible" when it is formed by a film that does not support its own weight. Preferably, the jacket is formed by a film that does not maintain itself by itself when it is disposed horizontal and is held solely by one of its ends. Preferably, the width of the film is greater than 2 cm ($10^{-2}$ m), its length is greater than 5 cm and its thickness is greater than 0.01 cm. According to one embodiment, its thickness is greater than 0.001 cm. Preferably, the film has the following dimensions: 3 cm long, 10 cm wide and 0.013 cm thick. Advantageously, and according to one embodiment, the film has a thickness of at least 0.001 cm.

It is also stated that, in the context of the present invention, the term "flexible pouch" or its equivalents are defined, among other things, as a volume that can be reduced by at least one third, preferably at least half and preferentially at least two thirds under the effect of the pressure exerted by one or two hands of the user. This effect is typically a compression force during which the user closes his fingers on his palm. This volume preferably has a single outlet.

Finally, it is stated that, in the context of the present invention, the term "standard force" that can be exerted by a hand is defined as the force that an adult can exert with his hand.

It is also stated that, in the context of the present invention, the term "wrong-side" is defined as the face of the film intended to be in contact with product to be contained.

It is also stated that, in the context of the present invention, the term "skin" is defined as the face of the film turned towards the outside of the product to be contained.

It is also stated that, in the context of the present invention, the term "release" is defined as the ratio between the quantity of product initially contained in the packaging and the content remaining at the end of use and which cannot be extracted or only with very great difficulty.

It is also stated that the "longitudinal" direction is taken along the axis along which the frustum has its maximum dimension. Thus this axis extends from the first to the second end, that is to say from the base to the closure device. In the figures, this axis is vertical.

It is also stated that the terms "sleeve" and "end piece" have the same meaning in the present document.

Before going into details of the preferred embodiments, in particular with reference to the figures, various options that the invention may preferentially but not limitatively present are stated below, these options being able to be implemented either alone or in any combination with each other:

Advantageously, the first film is closed on itself, being sealed by a "skin against wrong-side" sealing in order to form a frustum.

Through this feature, manufacture of the present invention is facilitated and the conical form thus formed naturally guides the content towards the end with the smallest cross section, corresponding to the outlet point.

Advantageously, the first film is sealed "skin against skin" initially and next sealed "wrong-side to wrong-side".

Advantageously, the film composing the jacket is sealed by "skin against wrong-side" sealing in order to form a frustum over a width of the jacket of between 1 and 20 mm and preferentially between 1 and 5 mm and advantageously equal to 5 mm.

Advantageously, the second end of the jacket follows the form of the contour of the base, the contour of the base having a geometric form configured so as to form in the jacket flow paths extending from the base in the direction of the first end.

Advantageously, the jacket and the base are configured so that the base can be twisted around an axis passing through the base and the sleeve under the effect of a manual action of the user.

Advantageously, the pouch has a volume that can be reduced by one quarter, preferably one third and preferentially at least half under the effect of one or more pressures exerted by one of two hands.

Thus the pouch is configured so that, under the effect of a pressure exerted by one or two hands of the user, its volume is reduced by one third, preferentially at least half and preferentially at least two thirds.

This feature affords very good release of the product, as well as great compactness when empty.

Advantageously, the jacket and the base are formed from the same material.

Advantageously, the ratio between the perimeter of the cross section of the jacket at the first end and the perimeter of the cross section of the jacket at the base is between 0.001 and 1, preferentially between 0.2 and 0.7, preferentially between 0.4 and 0.5.

Advantageously, the flexible pouch making up the main body of the device 1 is composed of the base and the jacket.

Advantageously, at least one from the first and second films is composed of at least one or more multilayer films.

Advantageously, the first and second films are multilayer films that offer various advantages such as:

- a thickness adaptable for flexible or more rigid feel;
- a sensation of touching the product;
- a protective barrier against certain types of radiation, such as ultraviolet, as a non-limitative example, but also ambient air by making the packaging hermetic;
- the possibility of printing on the external cladding of the packaging;
- the materials used can be recycled.

Advantageously, the material constituting the jacket is flexible.

Advantageously, the material constituting the base is flexible.

Advantageously, the base has a round shape.

Advantageously, the base has a polygonal shape.

Advantageously, the base has a polygonal shape in a plane perpendicular to the longitudinal direction.

Advantageously, the base has a polygonal shape, the corners of which are preferably rounded.

Advantageously, the base has a polygonal shape, the corners of which are rounded in a plane perpendicular to the longitudinal direction.

Advantageously, the base has a diamond shape.

Advantageously, the base has a diamond shape, the corners of which are preferably rounded.

Advantageously, the base has a geometric shape configured so as to cooperate with the jacket so that the jacket 201 forms flow paths.

Advantageously, the second end of the jacket matches the shape of the contour of the base, the contour of the base having a geometric shape configured so as to form in the jacket flow paths extending from the base in the direction of the first end.

Thus the pouch forms flow paths. This feature makes it possible to aggregate the product inside these paths under the effect of gravity or movements given to the packaging during use thereof. This thus affords better flow of the content inside the pouch.

Advantageously, the base has at least one corner, preferably rounded, and in which the pouch has a flow path extending longitudinally from each corner formed by the contour of the base.

Advantageously, each flow path extends from the base in the direction of the sleeve over at least half the height of the jacket and preferably over at least two thirds and preferably over the entire length of the jacket.

Advantageously, the base has a polygonal shape with rounded corners and the pouch has one or more flow paths extending from each corner of the base in the direction of the sleeve over at least half the height of the pouch and preferably over at least two thirds and preferably over the entire length of the pouch.

Advantageously, the base has a diamond shape, preferably with rounded corners, and the pouch has one or more flow paths extending from each corner of the diamond of the base in the direction of the sleeve over at least half the height of the jacket and preferably at least two thirds and preferably over the entire length of the jacket.

Advantageously, the pouch is configured so that the base deforms under the effect of manual pressure exerted by a user.

In the absence of pressure, the base has, with the exception of the sealing zones, a flat or curved form according to the weight of the product contained in the flexible pouch. Once the pouch is compressed manually, the base contracts and folds on itself. The deformation of the base affords better release of the product.

Advantageously, the jacket and the base are sufficiently flexible so that, under the effect of manual pressure exerted on the jacket, two points of the jacket disposed symmetrically with respect to a longitudinal axis of the packaging are put in contact. This improves release of the pouch 200. More generally, the jacket and the base are sufficiently flexible for two points of the jacket, apart in the absence of pressure, to be put in contact under the effect of manual pressure exerted on the jacket.

Advantageously, the jacket and the base are configured so that the pouch can be twisted around an axis passing through the base and the sleeve, under the effect of a manual action by the user. This is typically a longitudinal axis, for example the vertical axis with reference to the figures.

Advantageously, the jacket and the base are configured so that the base can be twisted by at least 180° and preferably at least 360° about an axis passing through the base and the sleeve, under the effect of a manual action by the user.

This makes it possible to have easier and more complete release, without risk of tearing the jacket.

Advantageously, the space requirement when empty can be reduced by compression of the pouch.

This feature makes it possible, at the end of use, when the device is empty of any product, to compress it so that its volume is reduced.

Advantageously, the first film has a thickness of between 10 and 300 micrometers and preferentially between 10 and 200 micrometers and the second film has a thickness of between 10 and 300 micrometers and the second film has a thickness of between 10 and 300 micrometers and preferentially between 10 and 200 micrometers.

Advantageously, the first film has a thickness of at least 400 micrometers.

Advantageously, the first and second films are identical.

The use of the same material for the base and jacket affords facilitated manufacture as well as identical mechanical behaviour of the elements making up the pouch.

Advantageously, the first and second films forming respectively the jacket and the base comprise a flexible film.

Advantageously, the first and second films forming respectively the jacket and the base comprise a single-layer and/or multilayer film.

Advantageously, the first and second films forming respectively the jacket and the base comprise a single-layer film.

Advantageously, the first and second films forming respectively the jacket and the base comprise a multilayer film.

Advantageously, the first and second films forming respectively the jacket and the base comprise a multilayer film made from polypropylene (OPP), biaxially oriented polyamide (OPA), aluminium and polyethylene (PE).

Advantageously, the first and second films forming respectively the jacket and the base comprise a multilayer film comprising at least one layer from: polypropylene (OPP), biaxially oriented polyamide (OPA), aluminium (Alu), polyethylene (PE), aluminium oxide polyethylene terephthalate (AlOx PET) and ethylene vinyl alcohol (EVOH).

Advantageously, the sleeve, or even the whole of the closure device, is made from high-density polyethylene (HDPE) and/or low-density polyethylene (LDPE) and/or polypropylene.

Advantageously, the base is sealed to the jacket by a sealing of the "wrong-side to wrong-side" type in order to form a flexible pouch.

This feature affords reinforcement of the periphery of the base, thus configured to provide stable holding of the device, whether the latter be empty and/or full and/or partly full.

Advantageously, the sealing of the jacket with the base extends longitudinally over a height h1 and the packaging extends longitudinally over a height h2, the ratio h1/h2 being between 0.001 and 0.1, preferentially between 0.001 and 0.05.

Advantageously, the sleeve is sealed to the jacket.

Advantageously, the sealing of the jacket with the sleeve extends longitudinally over a height h3 and the packaging extends longitudinally over a height h2, the ratio h3/h2 being between 0.001 and 0.2, preferentially between 0.1 and 0.15.

Advantageously, the jacket/sleeve sealing has a ratio between its height h3 and the cross section of the sleeve of between 0.001 and 1, preferentially between 0.001 and 0.6.

Advantageously, the sleeve is more rigid than the pouch. This feature provides better guidance of deposition during the use of the device.

Advantageously, the sleeve has an elliptical base. This elliptical form of the sleeve affords better cooperation of the sleeve with the jacket with regard to the sealing of the present device. In addition, this elliptical shape provides increased ease of manufacture.

Advantageously, the closure device comprises an accessory configured so as to cooperate with the sleeve.

Preferably, the accessory is fixed to the sleeve removable.

Preferably, the sleeve is configured so as to accept various accessories.

Advantageously, the present device has an accessory fixed to the sleeve and configured to allow holding of the device vertically with the sleeve downwards. The closure device then forms the contact interface between the packaging and the work surface.

Advantageously, the accessory is provided with silicone lips configured so as to separate from each other under the action of a force, advantageously a pressure, exerted by the user and to approach each other mutually so as to prevent access to the inside of the pouch in the absence of force on the part of the user.

Advantageously, the accessory is a stopper configured so as to screw onto the sleeve or rotationally articulated on the sleeve or for being snapped onto the sleeve.

Advantageously, the pouch is configured so as to compress under the action of manual pressure exerted by a user and to return to its initial form in the absence of pressure exerted by a user.

Thus the initial form of the device is found again after use of the device. This feature allows holding in the vertical position with the sleeve upwards after each use. It also affords good stability of the packaging even after having been compressed.

Advantageously, the pouch is configured so as to compress under the action of manual pressure exerted by a user and to remain compressed.

Thus, in the case of a product requiring a barrier against oxygen, the pouch keeps its compressed form in order to prevent any contact between the product inside the pouch and the surrounding air.

Advantageously, the present device can contain food products such as, as a non-limitative example, chocolate spread.

Advantageously, the present device may contain cosmetic products such as, as a non-limitative example, cream, powder, liquid or gel; industrial products such as, as a non-limitative example, grease, silicone, paint or powder; nutritional products such as for example gel; pharmacological or ophthalmic products such as for example gel, cream or liquid.

Advantageously, the present device may contain any kind of product able to be deposited by exerting at least one pressure on the device of the present invention.

Advantageously, the present invention affords better waste management through its capacity for deformation.

Advantageously, the present device results from an ecologically responsible design since it reduces the consumption of material (up to 3 times less weight compared with a bottle of the prior art for equivalent volume), multilayer film (up to 40% less surface area compared with the prior art for equivalent volume), and space compared with the packagings of the prior art.

It will be noted that the relative features stated above, in particular those relating to the flexibility of the packaging, to its ability to be deformed, to the sealing types, to the flow paths and to the form of the base, although advantageously working in synergy when they are combined, may be exploited independently of one another and nevertheless then confer certain technical advantages. The invention thus describes packagings that have only one or a combination of only some of the features mentioned above.

According to one possible embodiment serving as a non-limitative example presented by FIGS. 1, 2, 3, 4, 5, 6 and 7, the present invention 1 comprises a flexible jacket 201. This jacket 201 consists of a film. This jacket 201 is formed of a first film that includes a first inner side 201*a* and a first outer side 201*b*. This film is closed on itself. This film, once closed on itself, forms a frustum. In the context of this invention a frustum may have a cross section of any form without being limited to a circular cross section. This frustum has a first and second end. The cross section of this frustum thus formed narrows as the first end is approached.

This frustum is produced by a "skin against wrong-side" sealing of the film over a width of the jacket of between 1 and 20 mm and preferentially between 1 and 5 mm and advantageously equal to 5 mm.

This type of sealing affords better gripping of the device by a user, as well as more homogeneous deformation.

The film is preferably a multilayer film.

A base 202 is sealed to the jacket 201. The jacket 201 and the base 202 are sealed by a sealing 400 of the "wrong-side to wrong-side" type. This sealing 400 is carried out at the second end. Thus the jacket 201 and the base 202 form a pouch 200. The base 202 is formed from a flexible material. This flexible material may for example be of the same nature as the material of the jacket 201 and preferentially a single-layer or multilayer flexible film and advantageously made from OPP/OPA/ALU/EP or OPP/metallised polyester/PE. The base 202 is formed of a second film that includes a second inner side 202*a* and a second outer side 202*b*.

The present invention comprises a closure device 100. This closure device 100 is sealed at the first end of the jacket 201, the one with the smallest cross section. The closure device 100 may for example comprise a sleeve 102. Preferentially, the sleeve 102 is more rigid than the jacket 201. This sleeve 102 may, according to one embodiment, have a thread 105 on its external face that is not in contact with the product contained in the pouch 200. This thread 105 may server for fitting an accessory 101 of the closure device 100. The accessory 101 may be a stopper (cap, pump, etc) or a support having silicone lips 104 having a lid 106 for example.

This device 1 thus produced has very good stability in the vertical position, with the sleeve 102 upwards, and therefore resting on a jacket/base sealing 400. This sealing 400 is a sealing of the "wrong-side to wrong-side" type. This sealing therefore has greater rigidity since its thickness is equal to the sum of that of the jacket 201 and that of the base 202. This stability is acquired whether the device 1 be full or empty or partly full.

This device 1 also has the advantage of reduced bulk once empty, its pouch being flexible. It is possible to compress the pouch 200, with the stopper open, and to keep this shape if the stopper is closed again before the pressure forces exerted on the pouch 200 are stopped.

Finally, according to one embodiment, if the stopper remains open after the pressure forces are stopped, the device 1 resumes its initial shape, allowing holding vertically with sleeve 102 upwards.

According to another embodiment, after the pressure forces are stopped, and independently of the state of the stopper, the device 1 keeps its deformed shape. This has the advantage for example of preserving the product remaining in the flexible pouch from any contact with the surrounding air.

According to another embodiment, if the stopper remains open after the pressure forces are stopped, the device 1 partly resumes its initial shape.

The fact that the present invention has a deformable pouch 200 allows better release of the product contained inside. To facilitate this release as well as the handleability and precision of use of this device 1, the flexible pouch 200 has an improved capacity for deformation, enabling it to be deformed with one hand for a user with standard strength.

The base 202 of the present invention has any geometry, advantageously polygonal, preferentially polygonal with rounded corners, and preferentially polygonal in the form of a diamond with rounded corners. The geometry of the base 202 is able to cooperate with the jacket 201 so that the latter matches the form of the contour of the base 202. The base 202 has corners 206 and edges 207. At each corner, preferably rounded, formed by the base 202, the jacket 201 forms a path, referred to as a flow path 500, which extends from the base 202 in the direction of the sleeve 102. The flow paths 500 are thus formed inside the pouch 200 when a pressure exerted by a user of standard strength is present and/or absent. The preferentially polygonal geometry with rounded corners, and advantageously diamond geometry with rounded corners, makes it possible to form flow paths 500 that assist the aggregation of the product contained in the pouch 200 at the rounded corners when an external pressure is absent and/or present. These aggregations of material locally increase the ratio of the mass of material to be extracted to the contact surface between the material to be extracted and the internal wall of the jacket 200. This increase assists the descent of material towards the outside of the pouch 200. In the absence of any pressure being exerted, and according to the viscosity of the content in question, gravity may suffice to effect these aggregations of material and thus to assist their flow along these flow paths 500.

The present invention has a ratio between the perimeter of the sleeve 102 and the perimeter of the base 202 that may vary between 0.001 and 1, preferentially between 0.2 and 0.7, and preferentially between 0.4 and 0.5. The present invention has a ratio between the height 401 of the jacket/base sealing and the height 2 of the device that may vary between 0.001 and 0.1, preferentially between 0.001 and 0.05. Finally, the present invention has a ratio between the height 301 of the jacket/sleeve sealing and the height 2 of the device that may vary between 0.001 and 0.2, preferentially between 0.1 and 0.15.

These dimensions improve the stability of the device 1 while offering good capacity. In addition, the solid angle thus formed by the flexible pouch 200 affords good flow of the product contained in the flexible pouch 200.

An example of a device according to the invention will be described in more detail with reference to the figures.

FIG. 1 shows a perspective view of the device 1. A lid 106 closing the accessory 101 is positioned on the sleeve 102 of the device 1. The pouch 200 is held vertically by the jacket/base sealing 400. This sealing 400 is a "wrong-side to wrong-side" sealing. This sealing 400 is more rigid than the jacket 201 since the thickness of this sealing 400 is equal the sum of the thickness of the jacket 201 and that of the base 202. A greater thickness affords greater rigidity. This rigidity is located on the contour of the base 202. This more rigid contour affords better holding, vertically, of the present device 1.

Figure 1B:
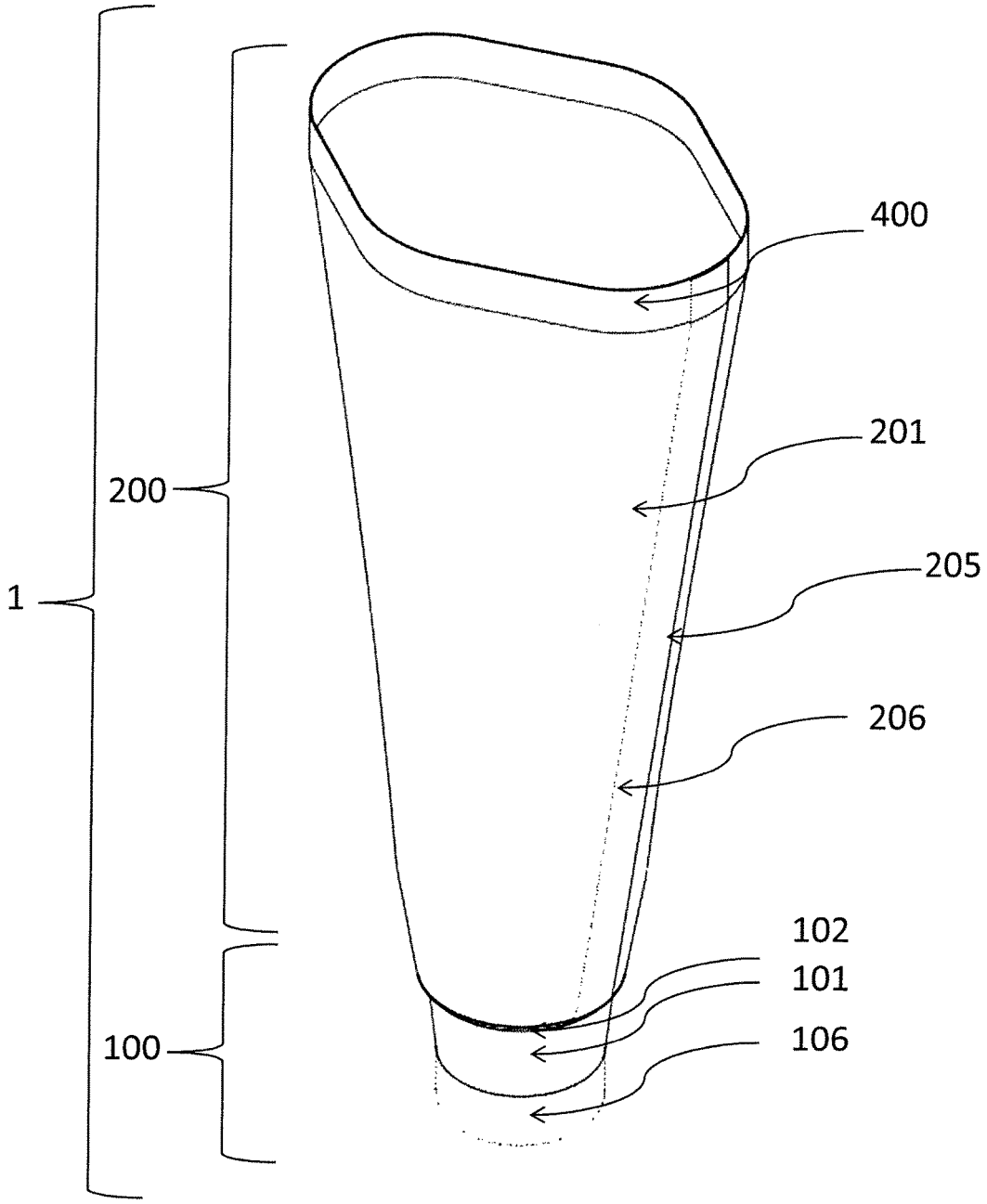
FIG. 1*b* depicts a perspective view of an example of a device according to an embodiment of the present invention with a lid and an accessory enabling the present invention to be held vertically with the sleeve downwards.

FIG. 1*b* shows a perspective view of the device 1. A lid 106 closing the accessory 101 is positioned on the sleeve 102 of the device 1. The pouch 200 is held vertically by the accessory 101, with the sleeve 102 downwards. In this position, the device 1 enables the product that it contains to descend towards the sleeve 102 by simple gravity, so that release of the product is facilitated during the next use.

FIGS. 1*a* and 1*b* show the skin to wrong-side sealing zone 205 of the jacket so the latter keeps its frustum shape when it is folded on itself. The broken line 206 illustrates the end of the jacket situated inside the frustum, the external face of which is in contact with the internal face of the end situated outside the frustum.

Figure 2:
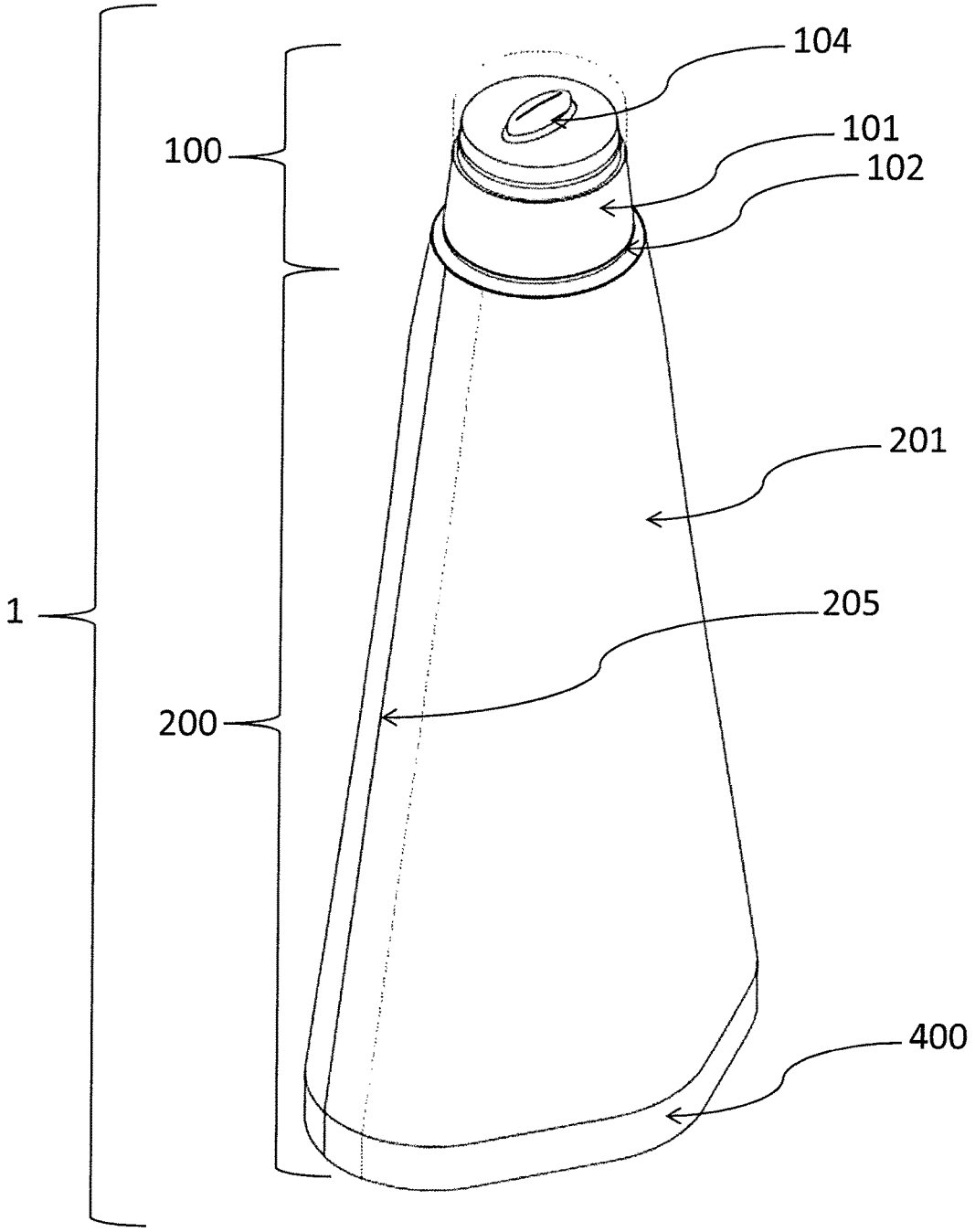
FIG. 2 depicts another perspective view of the device illustrated in FIG. 1*a* with the cover removed and with an accessory having silicone lips.

FIG. 2 shows a perspective view of the device 1 in the absence of the cover 106. According to a possible embodiment, the silicone lips 104 form part of the accessory 101 positioned on the sleeve 102 of the device 1. The pouch 200 is held vertically by the jacket/base sealing 400 that is more rigid than the jacket.

Figure 3:
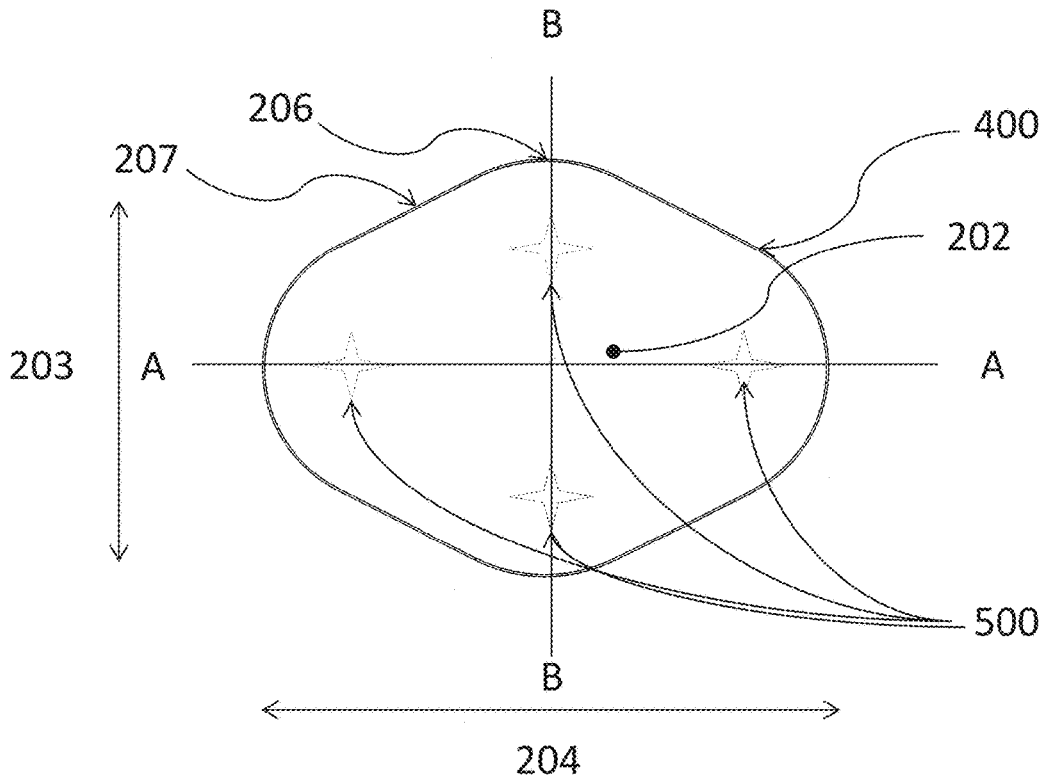
FIG. 3 depicts a view from below of the device illustrated in FIG. 1*a* with an illustration of the places where flow paths are formed.

FIG. 3 shows a view of the device 1 from below. According to one possible embodiment, the base 202 of the pouch 200 has a rounded diamond shape. The relative positions of four flow paths 500 according to this embodiment have also been marked by way of non-limitative example. These flow paths 500 are located close to the rounded corners of the geometric form of the base 202.

In the vertical position, with the sleeve 102 upwards, the whole of the content or product will descend towards the base 202 of the pouch 200. However, the geometry of the base 202 associated with the jacket 201 for forming the pouch 200 will allow the creation of flow paths 500 inside the device 1. This is because, according to this embodiment, the diamond geometry with rounded corners of the base 202 makes it possible, when a pressure exerted by a user of standard strength exerted on the pouch 200 is present and/or absent, with the sleeve 102 downwards and the lid 106 removed, to make the product contained in the pouch 200 descend. Preferentially, the geometry of the pouch 200 makes favoured flow paths 500 necessary, thus making the flow easier. Likewise, these favoured flow paths 500 reduce the intensity of the pressure necessary for emptying the product from the pouch 200. The release of the product is thus facilitated. Furthermore, with a reduction in the force, the user then gains in handleability, precision and management of the dose delivered.

Figure 4:
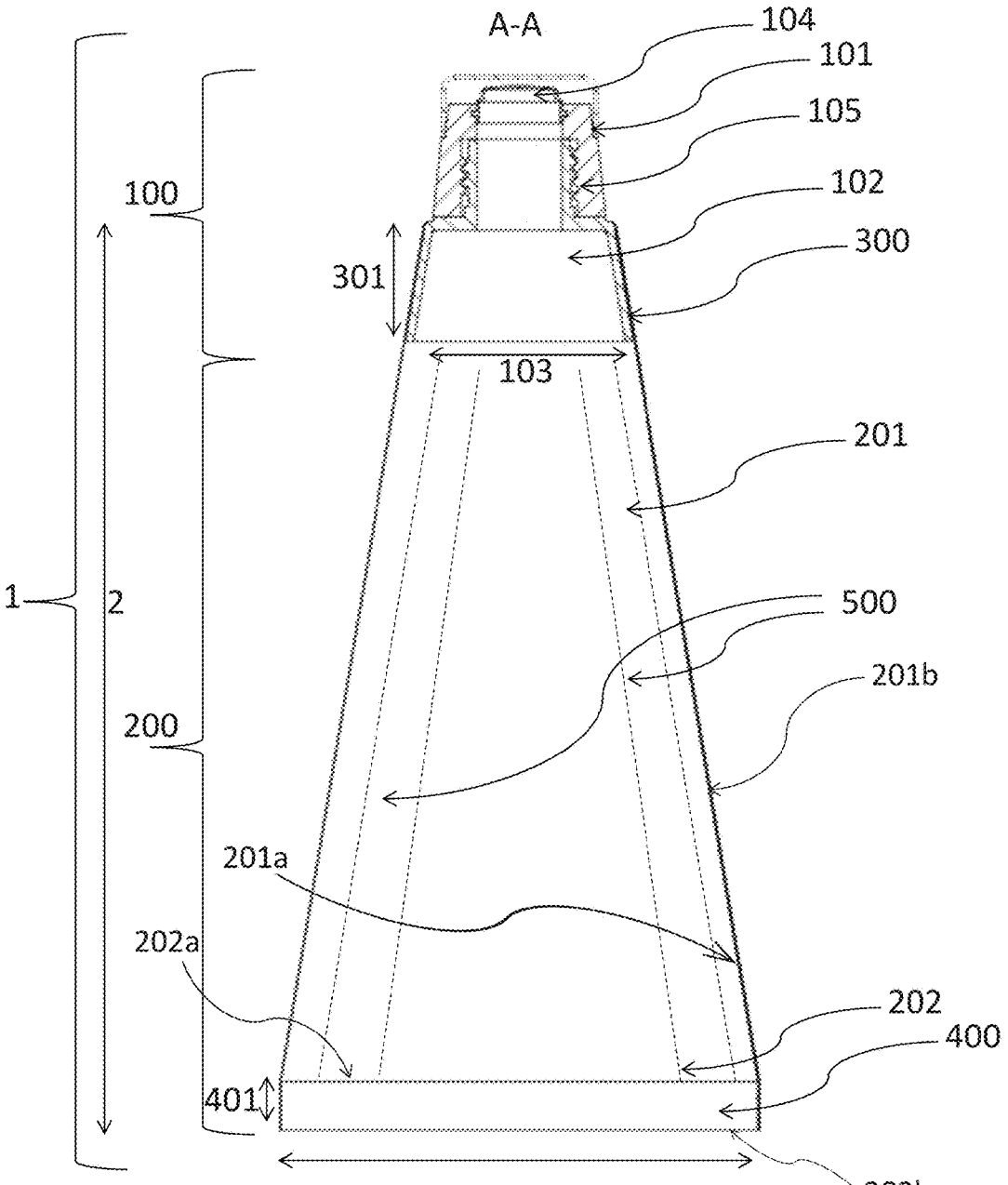
FIG. 4 depicts a view in front section of the device illustrated in FIG. 1*a*.
Figure 5:
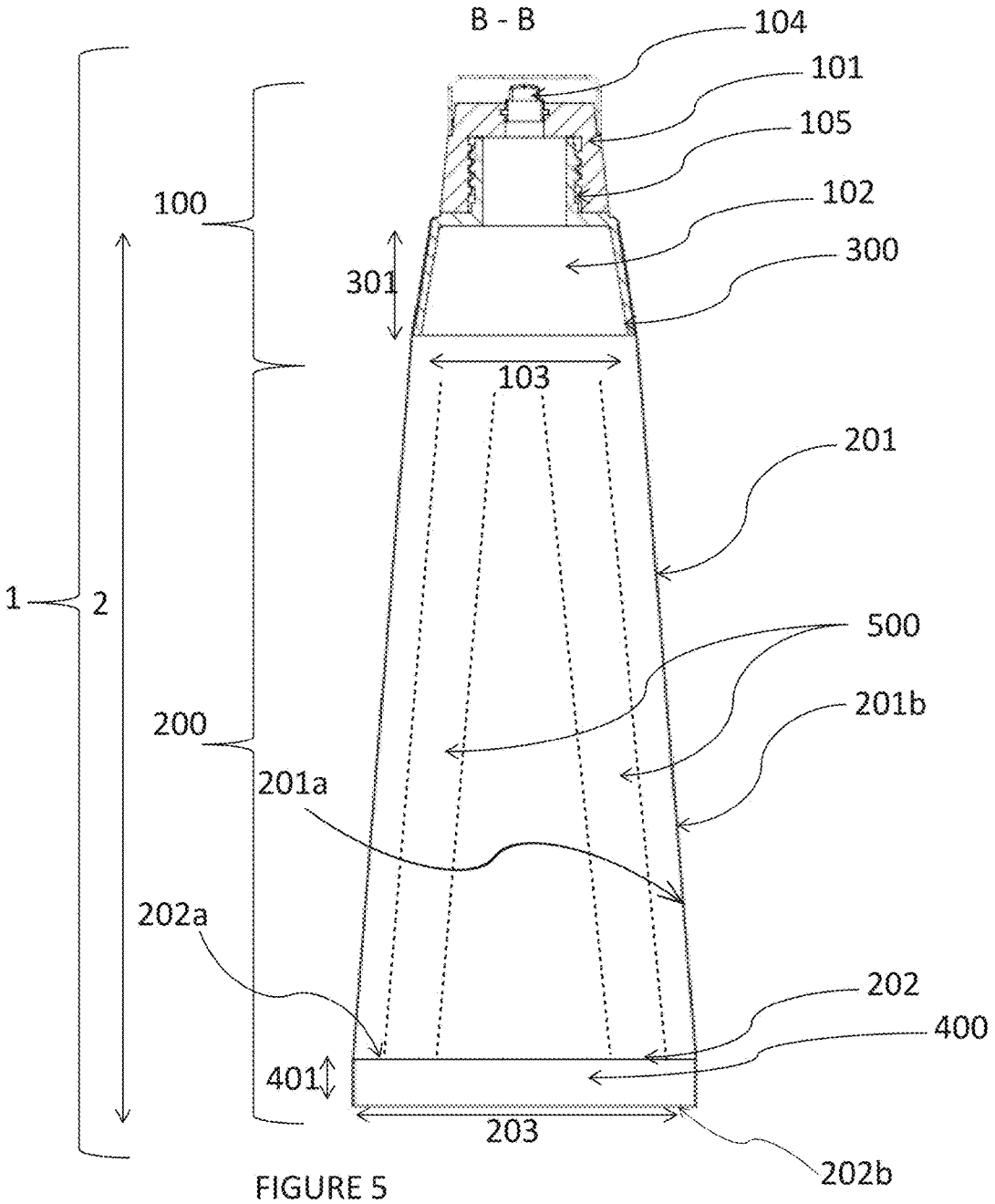
FIG. 5 depicts a view in profile section of the device illustrated in FIG. 1*a*.

FIGS. 4 and 5 show two views in cross section of the device 1 in the absence of the lid 106: respectively front and profile. Silicone lips 104 form part of the accessory 101 positioned on the sleeve 102 of the device 1 through a threading system 105. The sleeve 102 is sealed on the jacket. The pouch 200 is held vertical by the jacket/base sealing 400 in the form of a rounded diamond. The base 202 of the device 1 is sealed on the jacket 201 by a sealing of the "wrong-side to wrong-side" type. The base 202 and the jacket 201 are, according to one embodiment, produced from the same material and preferably from an identical film, for reasons of ease of manufacture, aesthetic appeal and handleability. The sealing of the base 202 with the jacket 201 provides reinforcement of the rigidity of the sealing. Moreover, the base 202 extends along a plane substantially perpendicular to the walls of the jacket 202, which maintains the shape of the jacket as required and reinforces the rigidity of the whole. This reinforcement of rigidity allows stable holding of the device 1 with sleeve 102 upwards independently of the quantity of product contained in the device 1. The dimensions 401 and 301 should also be noted, which correspond respectively to the height of the jacket/base sealing in the longitudinal direction and the height of the jacket/sleeve sealing in the longitudinal direction. Likewise, the height 2 of the device 1 in the longitudinal direction is entered in these two figures.

Figure 6:
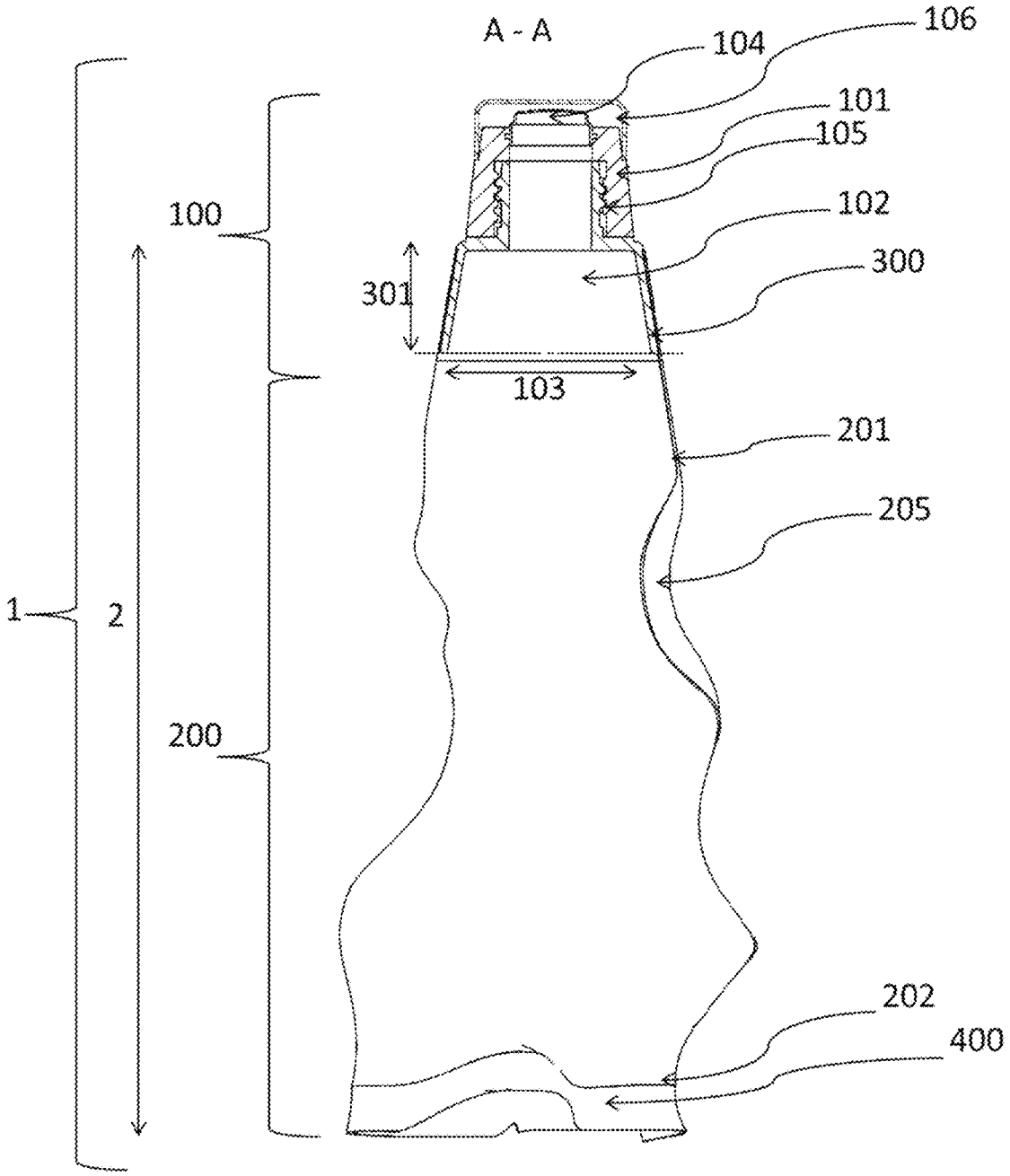
FIG. 6 depicts a view in cross section of the device illustrated in FIG. 1*a* in a deformation situation.

FIG. 6 shows a profile cross-sectional view of the device 1 deformed with the lid 106 present. The pouch 200 is deformed. Because of this, the base 202 and the jacket/base sealing 400 of the "wrong-side to wrong-side" type are also deformed. In particular, the pouch is configured so that the base 202 is crumpled or compressed. Finally, the "skin against wrong-side" sealing 205 of the jacket 201 is also deformed. Figure depicts a deformation of the present device illustrating the ability of the whole of the pouch 200 to deform. This deformation results typically from a compression exerted by the user with only one of his hands or with both hands. The rigidity of the closure device, and in particular of the sleeve, does not allow this deformation and reduction in volume under the effect of the manual force exerted by the user. Typically, the closure device and in particular the sleeve are produced from a rigid plastics material such as polypropylene, high-density polyethylene (HDPE), polyvinyl chloride (PVC), etc.

Figure 7:
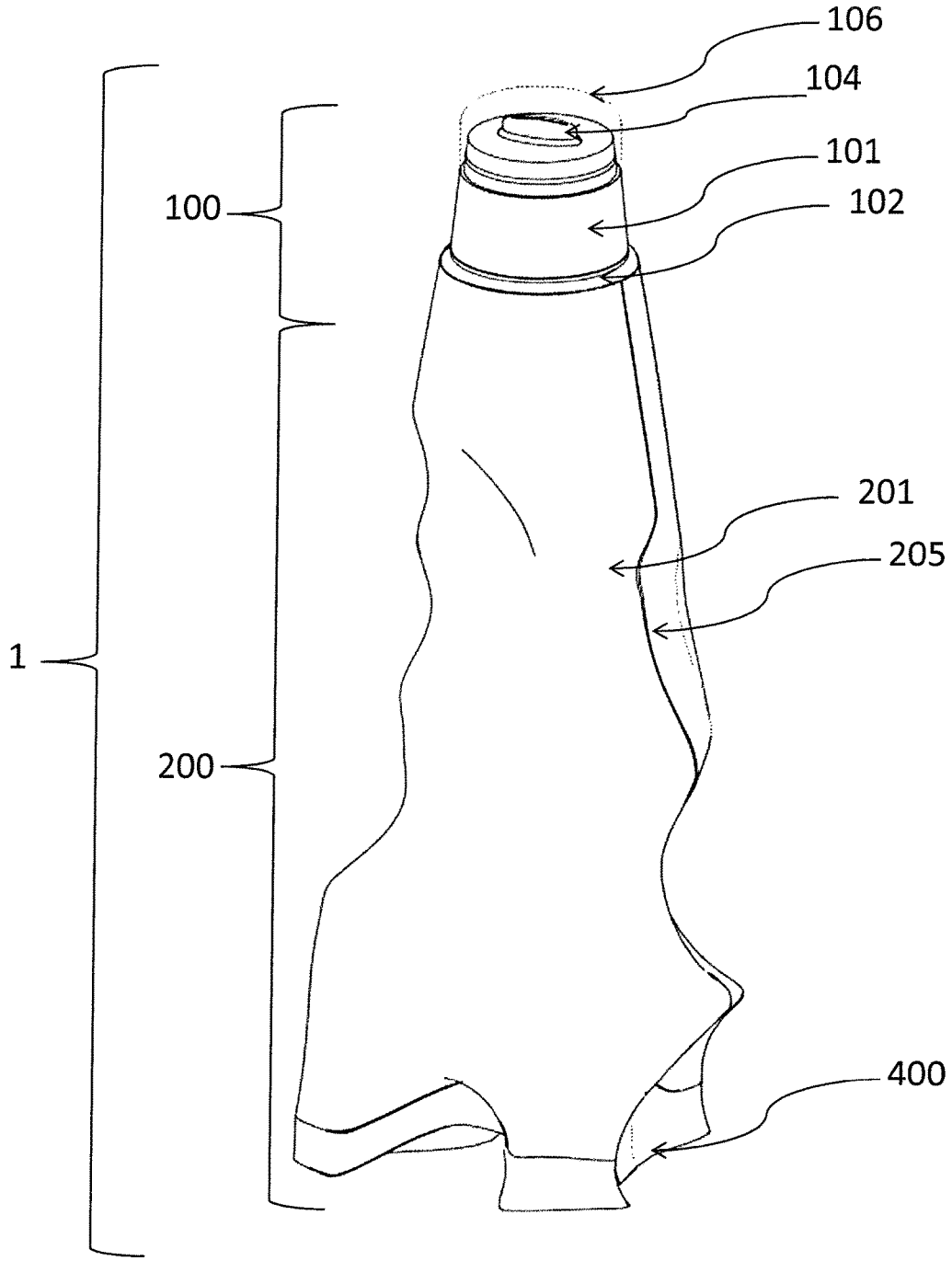
FIG. 7 depicts a perspective view of the device illustrated in FIG. 1*a* in a deformation situation.

FIG. 7 shows a perspective view of the device 1 deformed. According to one possible embodiment, a lid 106 closes the accessory 101 positioned on the sleeve 102 of the device 1. The pouch 200 is deformed. The deformation is visible at the base 202. The deformation is visible at the jacket/base sealing 400. Finally, the deformation is visible at the jacket/jacket sealing 205.

FIGS. 6 and 7 therefore illustrate a deformation of the pouch 200 showing that the whole of the pouch 200 is deformable, including the sealings 205, 400 and the base 202. This ability to be deformed confers great handleability on the pouch 200 and allows very good release of the product.

According to one embodiment, the pouch 200 has an increased capacity for deformation, which makes it possible to reduce the volume of the pouch 200 by at least one third, preferably at least one half and advantageously more than half of its volume when the device 1 is not deformed. This suitability for reducing the volume of the pouch 200 by exerting a pressure ensures very good release of the product contained in the pouch 200. The pouch 200 is configured so that these reductions in volume are obtained by a manual pressure exerted by the user using both hands and preferably only one of his hands.

According to one embodiment, the jacket 201 and the base 202 are sufficiently flexible so that, under the effect of manual pressure exerted on the jacket 201, two points disposed symmetrically with respect to a longitudinal axis of the packaging are put in contact. This makes it possible for example to effectively aggregate the product distributed over the internal surfaces of the jacket. When the surfaces are put in contact, the product distributed on the surfaces aggregates and it is then easier to make it fall towards the closure device.

Preferentially, the jacket 201 and the base 202 are configured so that the pouch 200 can be twisted around an axis passing through the base and the sleeve, under the effect of a manual action by the user, the sleeve 102 remaining immobile. Typically, the user holds the sleeve 102 with one of his hands and twists the base 202 with his other hand. Advantageously, the jacket 201 and the base 202 are configured so that the jacket 201 and/or the base 202 can be twisted by at least 360° about an axis passing through the base 202 and the sleeve 102, under the effect of a manual action by the user. This structural configuration therefore allows better release of the product, better handleability and therefore increased precision in deposition.

A particularly advantageous feature relates to the formation of flow paths 500 inside the packaging 1 through the judicious choice of the geometry of the base 202.

In the case where there is no force on the packaging 1 by a user, that is to say if the packaging 1 is placed with the sleeve 102 upwards, then only gravity has an effect on the content of the packaging 1. The geometric shape of the base 202 is able to cooperate with the jacket 201 so as to form the paths 500. In this situation, the flow takes place in the direction of the bottom of the packaging 1, there is aggregation of material at the flow paths 500, the mass of material increases while the contact surface of the material with the internal walls of the packaging 1 remains identical, thus creating a local increase in the flow that depends on the viscosity of the content.

Where there is force on the packaging by a user, the pouch 200 of the packaging 1 being flexible, the user can then exert a pressure on the pouch 200 so as to extract its content if the opening at the sealed sleeve 102 is free. The pressure exerted by the user brings together the adjacent surfaces of the pouch 200. This bringing together of the adjacent surfaces allows local aggregation of the product. This allows a routing of the paths 500 that is much more pronounced under the effect of the deformation. Thus, locally, the aggregation of material increases and affords better flow of the product, this accentuating the effect of the flow paths 500. This method then allows better release, particularly for viscous fluids.

Advantageously and by way of non-limitative example, the use of a geometry of the base 202 of the diamond type with rounded corners as illustrated in FIG. 3 makes it possible to form flow paths 500 that are naturally located at the rounded corners. It should be stated that the position of these flow paths 500 relates to the force that the packaging 1 of the present invention is subjected to as well as the geometry of its base 202 and/or of its jacket 201.

Furthermore, the general diamond shape makes it possible, by pressing on two opposite corners and bringing them together, for example by exerting two opposite forces on them with the fingers of the same hand, to decrease the other two corners of the diamond. The surfaces adjacent to these other two corners then move closer together in pairs, or even until they come into contact. This makes it possible to effectively aggregate the product distributed on the surfaces. This embodiment thus improves the release of the product. A jacket with a circular cross section would not make possible this bringing together of surfaces.

A second particularly advantageous feature relates to the type of sealing effected at the jacket 201. This is because a sealing 205 of the "skin against wrong-side" type to form the jacket 201 affords numerous advantages, both functional and aesthetic. This type of sealing, in comparison with "skin against skin" or "wrong-side against wrong-side" sealings, does not leave a fin on the internal or external face of the device. Fins have numerous advantages, for example external fins resulting from a "wrong-side to wrong-side" sealing leave on the surface of the packaging a band of projecting material that is more rigid than the rest of the packaging. This band of material is not pleasant when held in the hand. Moreover, it reduces the release of the product since it forms a rib opposing the deformation of the jacket. The deformation then caused by the user is lessened. In the case of a "skin against skin" sealing, the fin is situated inside the packaging, and holding in the hand is therefore not interfered with but the corners formed by this internal fin offer resistance to the deformation of the packaging and presents good release of the product.

Conversely, the use of a "skin against wrong-side" sealing does not form a fin, either internal or external. With this type of sealing, the packaging 1 is much more homogeneous to touch and to look at. In addition, concerning the handleability and the deformation of packaging of this type, "skin against wrong-side" sealing provides improved deformation of the whole of the jacket 201 in comparison with other types of sealing which, through the presence of fins, inevitably forming ribs, reduces its amplitude of deformation. "Skin against wrong-side" sealing thus offers greater amplitude of deformation and therefore of compression, and an improvement in the release of the product, in the handling of the packaging, in the comfort of the user and therefore in the precision of deposition results therefrom.

The invention finds a particularly advantageous application in the food sector with for example the use of chocolate spread as a substance to be contained. It also finds a particularly advantageous application in the industrial, cosmetic, domestic and health sectors.

The invention is not limited to the embodiments described above and extends to all embodiments covered by the claims.

According to one embodiment, the present invention also relates to a method for manufacturing at least one packaging according to the invention.

Figure 8:
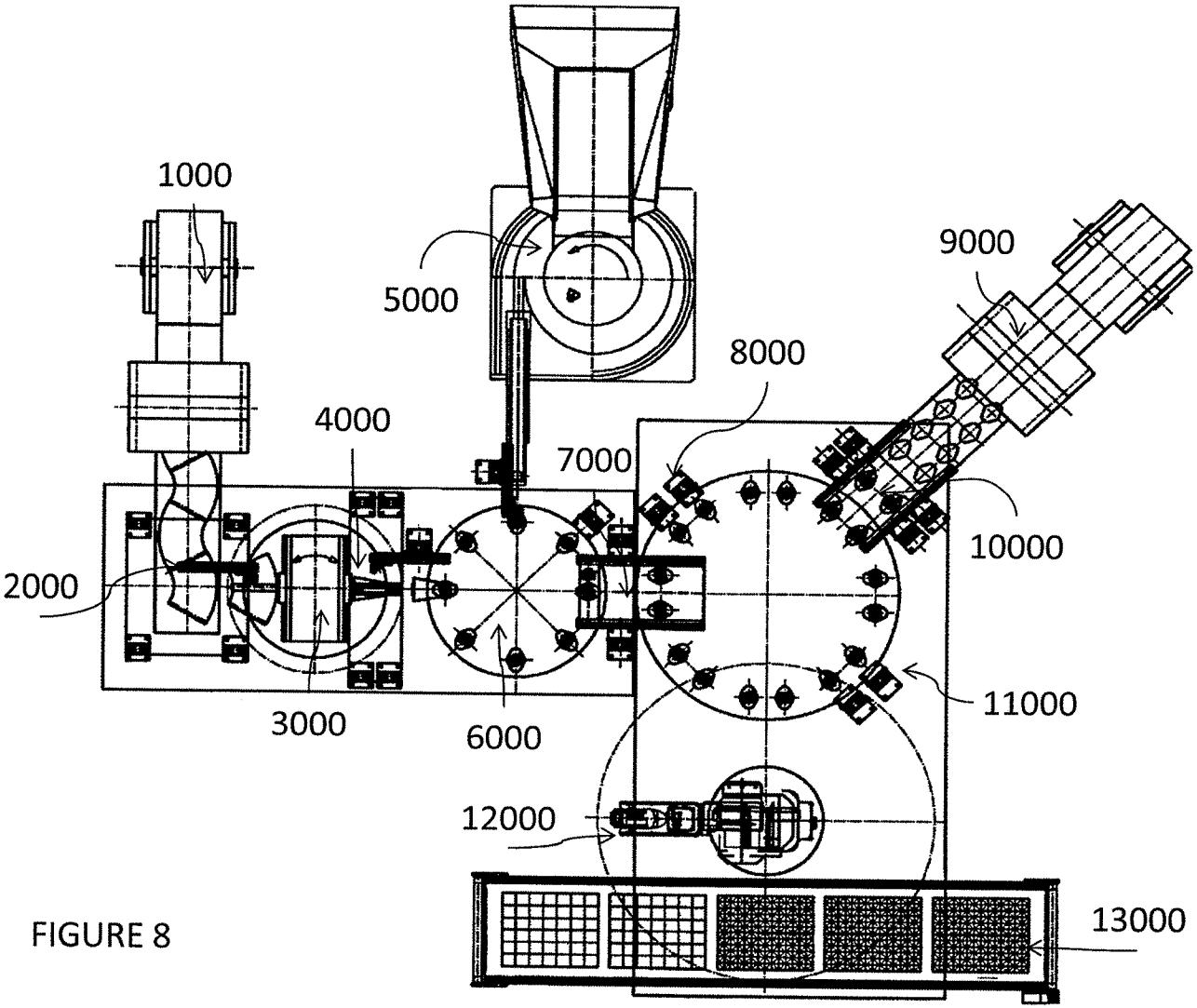
FIG. 8 depicts a schematic representation of a line for manufacturing the present device illustrated in FIG. 1*a* according to one embodiment.

FIG. 8 presents the various steps of the method according to one embodiment as well as the industrial equipment enabling it to be produced. This method comprises a first step of cutting the pattern of the jacket in a film. This film, preferably multilayer, comes from a roll. This roll is unwound by the cutting machine 1000. Next, the device 2000 manipulates the pattern of the jacket and closes it on itself in order to give it a frustum shape. This manipulator is able to cooperate with the sealing device 3000.

The device 3000 comprises a heating device able to come into contact with the internal face and the external face of the jacket. At this stage of the method, the jacket is held closed on itself, forming a frustum. In this configuration the heating device carries out a "skin against wrong-side" sealing of the jacket. This sealing is carried out in the longitudinal direction of the jacket. This sealing is carried out over the entire length of the jacket in its longitudinal direction.

This sealing thus forms the zone 205 illustrated in the previous figures. This sealing is carried out over a width of the jacket of between 1 and 20 mm and preferentially between 1 and 5 mm and advantageously equal to 5 mm.

Next a frustum-loading manipulator 4000 positions said frustum on a sealing station 6000. This sealing station receives firstly the frustums and sleeves. The sleeves are supplied by the device 5000. At the sealing station 6000, the sleeves are sealed at the part of the frustum with the smallest cross section. Then the station 7000 transfers the jackets sealed with a sleeve to the station 10000 for formatting and sealing the base and jacket. The station 8000 forms the jacket with a view to sealing thereof with the base. The bases are cut from a film, the material of which is preferentially identical to that of the jacket. The station 9000 cuts the bases from a roll of film. Once at the station 10000, the bases are sealed on the part of the frustum having the largest cross section. This sealing is a "wrong-side against wrong-side" sealing. This sealing has a height in the longitudinal direction of the jacket of between 1 and 20 mm and preferentially between 1 and 10 mm and advantageously equal to 10 mm.

Finally and optionally, the device 11000 carries out a sealing test on the newly formed pouch. Then a manipulator 12000 places the pouches on an accumulator belt 13000 for the finished pieces.

With regard to the filling of the present device, there exist a plurality of embodiments:

According to one embodiment, the present invention can be filled with the product to be contained after the sealing of the sleeve 102 and before the sealing of the base 202. The filling then takes place through the second end intended to receive the base 202 subsequently.

According to another embodiment, the present invention can be filled with the product to be contained before the sealing of the sleeve 102 and after the sealing of the base 202. The filling then takes place through the first end intended to receive the sleeve 102 subsequently.

According to another embodiment, the present invention can be filled with the product to be contained after the sealing of the sleeve 102 and after the sealing of the base 202. The sealing then takes place through the sleeve 102.

The present invention affords protection of the product contained in the packaging via at least two distinct ways. The first way concerns the use of materials blocking, according to the field of application, certain radiation such as ultraviolet, by way of non-limitative examples.

One of the advantages of the present invention relates to its sizing. This is because the possibility of implementing the present invention according to various dimensions makes it possible to use this packaging for medical, industrial and food applications, by way of non-limitative examples. Advantageously, the thickness of the materials used can be optimised in order to meet the requirements and constraints of the fields of application of the present invention.

The present invention has the advantage of a very realistic sensation of touch of the product. This advantage is partly obtained by the use of fine films and of particular materials indicated previously. This sensation of touching the product provides better control of the release of the product by the user, in particular when the fluid is viscous or non-homogeneous. In addition, the user has the sensation of touching the product, which provides better control and greater precision in the use of the present invention.

The present invention allows important personalisation of the packaging since the external surface thereof has a surface allowing printing of any type of pattern or text for advertising and/or informative purposes. By way of non-limitative example, it is possible to print a logo, an image, a photograph, a text, a title or instructions for use.

The present invention has the advantage of being at least partly recyclable since at least some of the materials used can be recycled. According to a particularly advantageous embodiment, all the packaging can be recycled.

Similarly, the present invention affords a significant reduction in the quantity of materials used for the packaging and thus affords at the same time a reduction in manufacturing costs, but also a reduction in the ecological impact of the production of the packaging. Thus, for example, the present invention affords a reduction by a factor of at least 2 in the quantity of material used for packaging for equivalent volume compared with the prior art. This reduction in quantity of material is accompanied by a reduction by a factor of at least 3 in the weight of the packaging for equivalent volume compared with the prior art. In addition, to continue the ecologically responsible aspect of the present invention, its design and the materials used allow a release of at least 10% additional product compared with the prior art through its handleability, its flexibility and its geometric design. Finally, through its design and geometry, the present invention affords a reduction in storage space, thus making it possible to transport an equal quantity of product at lower cost.

REFERENCES

1. Packaging
2. Height of packaging in longitudinal direction
100. Closure device
101. Accessory
102. Sleeve
103. Cross section of the sleeve
104. Silicone lips
105. Thread
106. Lid
200. Pouch
201. Jacket/frustum
202. Base
203. Small cross section of base
204. Large cross section of base
205. Jacket/jacket sealing
300. Jacket/sleeve sealing
301. Height of jacket/sleeve sealing in longitudinal direction
400. Jacket/base sealing
401. Height of jacket/base sealing in longitudinal direction
500. Flow paths
1000. Machine for cutting jackets 201
2000. Manipulator for jackets 201
3000. Station for "skin against wrong-side" sealing 205 of jackets 201
4000. Manipulator of frustum
5000. Station supplying sleeves 102
6000. Station for jacket/sleeve sealing 300
7000. Transfer station
8000. Station for formatting jackets 201
9000. Machine for cutting bases 202
10000. Station for formatting bases 202 and "wrong-side to wrong-side" jacket/base sealing 400
11000. Sealing test station
12000. Manipulator
13000. Accumulator belt for finished pieces

The invention claimed is:

1. A packaging comprising a pouch intended to contain a product and to allow release thereof, comprising:

a manually deformable jacket formed of a first film that collapses under its own weight, the first film comprising a first inner side and a first outer side, the first film being closed on itself so as to form a frustum having a first and second end, the cross section of the frustum narrowing as the first end is approached, the inner side forming the interior of the frustum and the outer side forming the exterior of the frustum;

a base formed of a second film that collapses under its own weight, the second film comprising a second inner side and a second outer side and the second film being sealed at the second end of the frustum so as to close off the second end, the base and the jacket are thermally sealed first inner side to second inner side in order to form together a manually deformable pouch, the first and second inner side being configured to be in contact with the product;

a closure device through which the product flows when the pouch is manually deformed and comprising a sleeve sealed to the first end of the frustum, wherein the base has a diamond shape including a first, a second, a third, and a fourth angle, the first angle being equal to the third angle and opposite to the third angle, the second angle being equal to the fourth angle and opposite to the fourth angle, the first angle being different from the second angle.

2. The packaging according to claim 1, in which the first film is closed on itself while being sealed first inner side to first outer side in order to form the frustum.

3. The packaging according to claim 1, in which the base has rounded corners.

4. The packaging according to claim 3, in which each flow path extends from the base in the direction of the sleeve over at least half of a height of the jacket.

5. The packaging according to claim 1, in which the base has a contour defining the diamond shape, the second end of the jacket matches the shape of the contour of the base, the contour of the base is configured to allow the product to flow forming in the jacket flow paths of the product extending from the base toward the first end.

6. The packaging according to claim 1, in which the base has a contour having at least one corner, and in which the pouch is configured to allow the product to flow forming in the jacket flow paths of the product extending longitudinally from each corner formed by the contour of the base toward the first end.

7. The packaging according to claim 1, in which the pouch is configured to allow the product to flow forming in the jacket one or several flow paths of the product extending from each corner of the diamond shape of the base in the direction of the sleeve over at least half a height of the jacket.

8. The packaging according to claim 1, in which the jacket and the base are sufficiently flexible so that, under an effect of a manual pressure exerted on the jacket, two points on the jacket symmetrically disposed from apart a longitudinal axis of the packaging are put in contact.

9. The packaging according to claim 1, in which the jacket and the base are configured so that the pouch can be twisted about an axis passing through the base and the sleeve, under the effect of a manual action by the user.

10. The packaging according to claim 1, in which the jacket and the base are configured so that the base can be twisted by at least 180° about an axis passing through the base and the sleeve under the effect of a manual action by a user.

11. The packaging according to claim 1, in which at least one from among the first and second films is a multilayer film.

12. The packaging according to claim 1, in which the first film has a thickness of between 10 and 300 micrometers and in which the second film has a thickness of between 10 and 300 micrometers.

13. The packaging according to claim 1, in which the base and the jacket are formed by films comprising the same materials.

14. The packaging according to claim 1, in which the sealing of the jacket with the base extends longitudinally over a height h1 and the packaging extends longitudinally over a height h2, the ratio h1/h2 being between 0.001 and 0.1.

15. The packaging according to claim 1, in which the sleeve is more rigid than the pouch.

16. The packaging according claim 1, in which the closure device comprises an accessory configured so as to cooperate with the sleeve, the accessory being provided with silicone lips configured to move away from each other under the action of a force exerted by a user and to move mutually closer together so as to prevent access to the inside of the pouch in the absence of force on the part of the user.

17. The packaging according to claim 1, in which the pouch is configured so that the base is deformed under an effect of manual pressure exerted by a user.

18. The packaging according to claim 1, in which the first angle is disposed in front of the third angle, and the second angle is disposed in front of the fourth angle.

19. The packaging according to claim 18, in which the diamond shape has rounded corners.

20. The packaging according to claim 1, in which the base has a first corner defining the first angle, a second corner defining the second angle, a third corner defining the third angle, and a fourth corner defining the fourth angle, the first and third corners having equal radiuses of curvature, the second and fourth corner having equal radiuses of curvature, the radius of curvature of the first corner being different from the radius of curvature of the second corner.

* * * * *